US010414645B1

(12) United States Patent
Laible

(10) Patent No.: US 10,414,645 B1
(45) Date of Patent: Sep. 17, 2019

(54) CONTAINER INSERT FOR USE IN A CLOSED LOOP DISPENSING SYSTEM

(71) Applicant: Rodney Laible, Omaha, NE (US)

(72) Inventor: Rodney Laible, Omaha, NE (US)

( * ) Notice: Subject to any disclaimer, the term of this patent is extended or adjusted under 35 U.S.C. 154(b) by 0 days.

(21) Appl. No.: 16/267,867

(22) Filed: Feb. 5, 2019

(51) Int. Cl.
*B67D 7/04* (2010.01)
*B65D 47/32* (2006.01)
*B65D 47/38* (2006.01)

(52) U.S. Cl.
CPC ..... *B67D 7/04* (2013.01); *B65D 47/32* (2013.01); *B65D 47/38* (2013.01)

(58) Field of Classification Search
CPC . B67D 7/04; B67D 3/042; B67D 3/04; B65D 47/32; B65D 47/38; B65D 47/06; B65D 47/061; B65D 47/068; B65D 41/20; B65D 41/50; B65D 51/20; B65D 51/22; B65D 51/222; B65D 2251/0059; B65D 2251/0062; B65D 2251/009; B65D 2251/0093; A61J 1/1406
USPC ..... 222/481.5
See application file for complete search history.

(56) References Cited

U.S. PATENT DOCUMENTS 5,433,330 A * 7/1995 Yatsko ..... A61J 1/1406 215/247
5,632,315 A * 5/1997 Rose ..... A61J 1/2089 141/329
5,954,233 A * 9/1999 Kawashima ..... B65D 51/222 222/83
5,988,456 A 11/1999 Laible
6,142,345 A 11/2000 Laible
6,477,743 B1 * 11/2002 Gross ..... B65D 47/244 222/212
6,571,971 B1 * 6/2003 Weiler ..... B65D 1/0238 215/247
6,669,062 B1 12/2003 Laible
6,923,345 B1 * 8/2005 Laible ..... B67D 7/0294 222/185.1
6,945,433 B2 * 9/2005 Laible ..... B67D 7/0294 222/185.1
6,968,983 B2 11/2005 Laible
9,242,847 B1 * 1/2016 Laible ..... B67D 7/0294
9,458,003 B1 * 10/2016 Laible ..... B67D 7/0266
2002/0121525 A1 * 9/2002 Stillinger ..... B65D 47/2025 220/705
2002/0121531 A1 * 9/2002 Stillinger ..... B65D 47/2025 222/525
2003/0208165 A1 * 11/2003 Christensen ..... A61M 39/045 604/256
2007/0243348 A1 * 10/2007 Yang ..... A61J 1/1406 428/34.7
2010/0213215 A1 * 8/2010 Laible ..... B67D 7/02 222/185.1

(Continued)

*Primary Examiner* — Benjamin R Shaw
(74) *Attorney, Agent, or Firm* — Dennis L. Thomte; Thomte Patent Law Office LLC

(57) ABSTRACT

An insert is disclosed for use with a closed loop dispensing system. The insert is press-fitted into the throat of a liquid container. The insert includes a normally closed chemical valve which is opened when pierced by a vertically movable lance to permit the liquid in the container to be dispensed to a mixing machine or the like. The insert also includes a plurality of radially spaced-apart bi-directional valves which automatically permit air to be vented into the container. The bi-directional valves also permit off-gassing of gas in the container.

15 Claims, 12 Drawing Sheets

(56) References Cited

U.S. PATENT DOCUMENTS

| | | | | |
|---|---|---|---|---|
| 2010/0213220 | A1* | 8/2010 | Laible | B67D 7/0277<br>222/481.5 |
| 2010/0258593 | A1* | 10/2010 | Laible | B65D 47/283<br>222/478 |
| 2010/0308056 | A1* | 12/2010 | Brandenburger | A61J 1/2096<br>220/345.1 |
| 2012/0184938 | A1* | 7/2012 | Lev | A61J 1/1406<br>604/414 |
| 2013/0299021 | A1* | 11/2013 | Gobbi Frattini | A61M 39/045<br>137/624.27 |
| 2014/0190973 | A1* | 7/2014 | Kerman | B65D 35/44<br>220/278 |
| 2015/0096999 | A1* | 4/2015 | Nini | B67D 3/043<br>222/81 |
| 2017/0297788 | A1* | 10/2017 | Defert | B65D 1/0246 |

* cited by examiner

CONTAINER INSERT FOR USE IN A CLOSED LOOP DISPENSING SYSTEM

BACKGROUND OF THE INVENTION

Field of the Invention

This invention relates to a container insert for use in a closed loop dispensing system. More particularly, this invention relates to a container insert which is press-fitted into the throat of a liquid container. Even more particularly, this invention relates to a container insert which is entirely recyclable. Even more particularly, the container insert of this invention is automatically self-venting. Even more particularly, the container insert of this invention is manufactured by an over-molding process which reduces overall part count and overall assembly time. Even more particularly, the container insert of this invention includes a normally closed valve therein which prevents liquid flow upwardly therethrough, but which permits liquid flow upwardly therethrough upon being pierced by a vertically movable lance movably positioned in a cap assembly mounted on the throat of the container.

Description of the Related Art

Many container inserts have been provided for insertion into the throat of a container containing liquid chemical. Applicant has previously received U.S. Pat. Nos. 9,242,847; 6,968,983; 6,669,062; 6,142,345 and 5,988,456 wherein inserts have been provided which are inserted into the throat of a liquid container. Applicant's earlier patents represent an advance in closed loop dispensing systems. However, the container inserts of Applicant's earlier patents involve considerable parts requiring some assembly time.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A container insert is disclosed for use with a closed loop dispensing system including a container having a throat with an inside surface. The insert includes a substrate portion having an over-molded portion thereon. The substrate portion includes a horizontally disposed ring-shaped lip having an upper side, a lower side, an outer end and an inner end. The substrate also has a generally cylindrical upper wall member having an open upper end, an open lower end, an inner side and an outer side. The upper wall member of the substrate extends downwardly from the inner end of the lip whereby the lip protrudes outwardly from the upper end of the upper wall member. The substrate portion includes a horizontally disposed and generally disc-shaped wall at the lower end of the upper wall member, and which has an inner end, an outer end, an upper side and a lower side. The substrate also includes a generally cylindrical lower wall member, having an open upper end and an open lower end, an inner side and an outer side, with the lower wall member extending downwardly from the outer end of the disc-shaped wall whereby the lower end of the upper wall member is positioned outwardly of the upper end of the lower wall member. The substrate also includes a vertically disposed and cylindrical hollow tube, having an open upper end and an open lower end, which is positioned at the center of the disc-shaped wall. The open upper end of the hollow tube is positioned above the disc-shaped wall and the open lower end of the hollow tube is positioned below the disc-shaped wall. The disc-shaped wall of the substrate has a plurality of radially spaced-apart openings formed therein outwardly of the hollow tube. The lip, upper wall member, the upper end of the hollow tube and the disc-shaped wall of the substrate are over-molded with a plastic material.

A flexible valve, having an upper side and a lower side, is positioned on the open upper end of the over-molded hollow tube to normally close the open upper end of the over-molded hollow tube. The flexible valve may be opened as will be described hereinafter thereby permitting liquid from the container to pass upwardly therethrough. The disc-shaped wall of the over-molded portion has a plurality of radially spaced-apart openings formed therein which register with the radially spaced-apart openings in the disc-shaped wall of the substrate. The disc-shaped wall of the over-molded portion has a plurality of hollow protrusions which extend downwardly through the openings in the disc-shaped wall thereof and through the radially spaced-apart openings in the disc-shaped wall of the substrate with each of the protrusions having an open upper end and open lower end. Each of the protrusions has a bi-directional valve at the lower end thereof. Each of the bi-directional valves are normally closed to prevent liquid from passing upwardly therethrough. Each of the bi-directional valves are movable downwardly to an open position to permit air to pass downwardly therethrough to vent the container. Each of the bi-directional valves are movable upwardly to an open position to permit the gas in the container to be de-gassed upwardly therethrough.

A dip tube is in communication with the lower end of the hollow tube of the container insert and which is in liquid communication with the liquid in the liquid container. A dispenser cap assembly is removably mounted on the throat of the container. The dispenser cap assembly includes a vertically movable lance for piercing and opening the flexible valve upon the lance being vertically moved to a lower position.

It is a principal object of the invention to provide an improved container insert for use in a closed loop dispensing system.

A further object of the invention is to provide a container insert which is entirely recyclable.

A further object of the invention is to provide a container insert which reduces the cost of manufacturing the same due to an over-molding process that reduces the overall part count and overall assembly time.

A further object of the invention is to provide a container insert which is automatically self-venting.

A further object of the invention is to provide a container insert which includes a plurality of bi-directional valves for air venting and chemical off-gassing.

A further object of the invention is to provide a container insert which is economical of manufacture and durable in use.

It is a further object of the invention to provide a container insert including a center chemical flow channel which remains completely sealed during shipping until pierced by a lance within the cap adapter thereof.

A further object of the invention is to provide a self-sealing valve on the center flow channel which will close when the chemical dispensing lance is removed therefrom.

A further object of the invention is to provide a container insert which does not have a metal spring within the container insert.

A further object of the invention is to provide a container insert having a configuration that prevents all other cap adapters from being used with the container insert of this invention.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
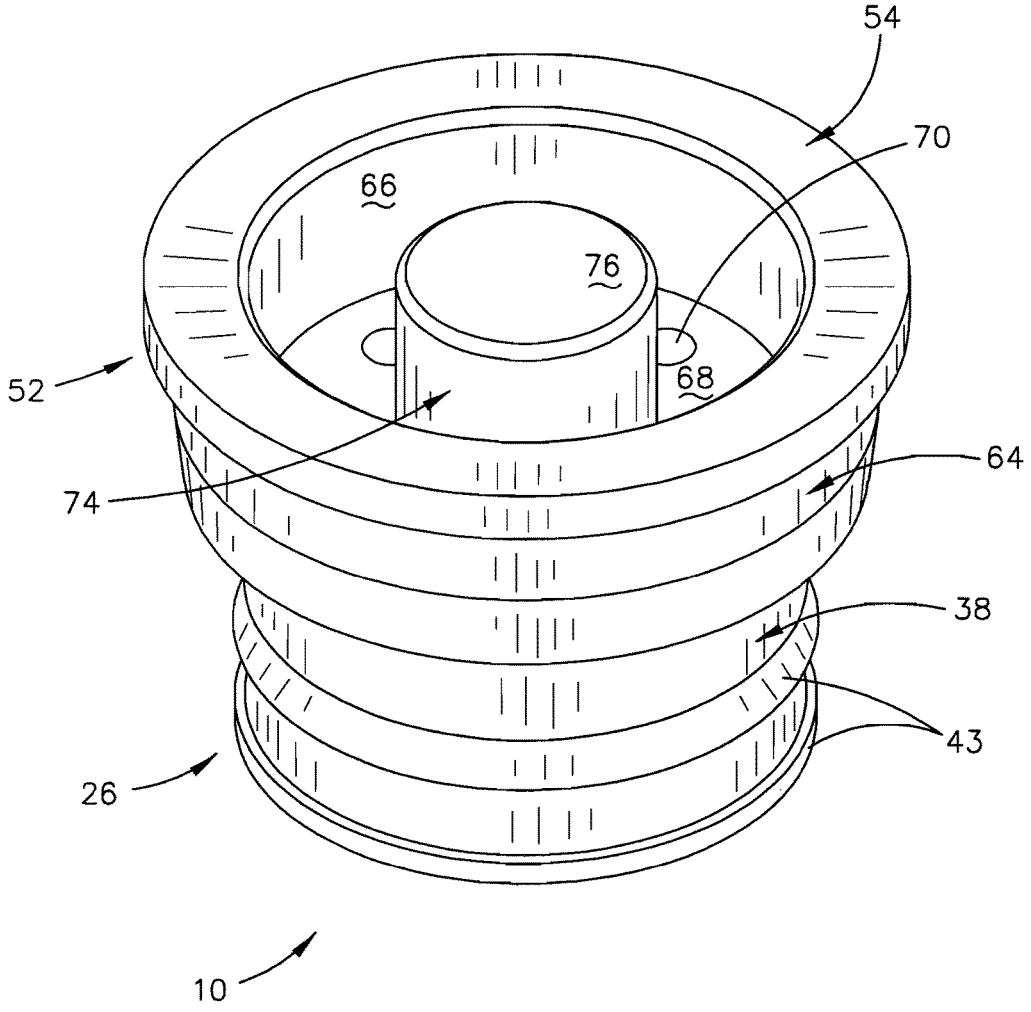
FIG. 1 is a perspective view of the container insert of this invention.
Figure 2:
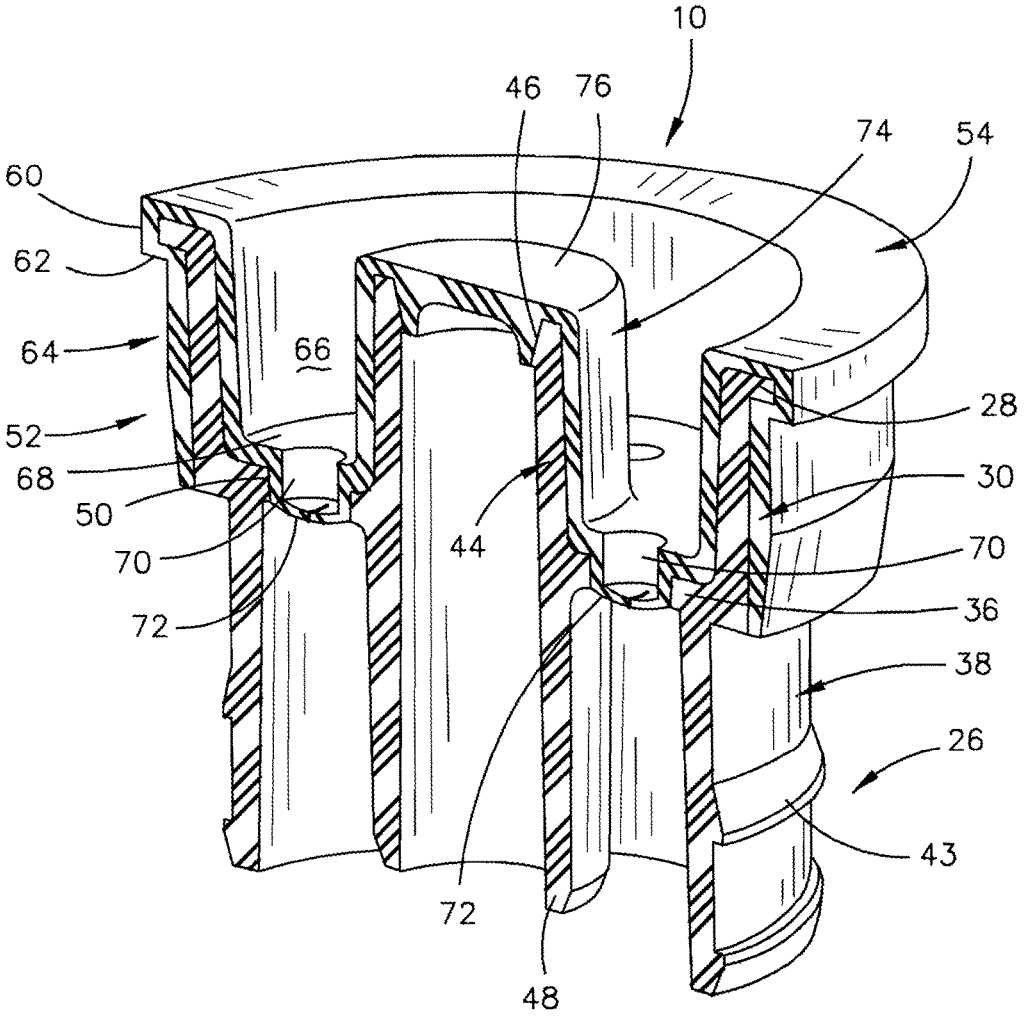
FIG. 2 is a perspective sectional view of the container insert of this invention.
Figure 3:
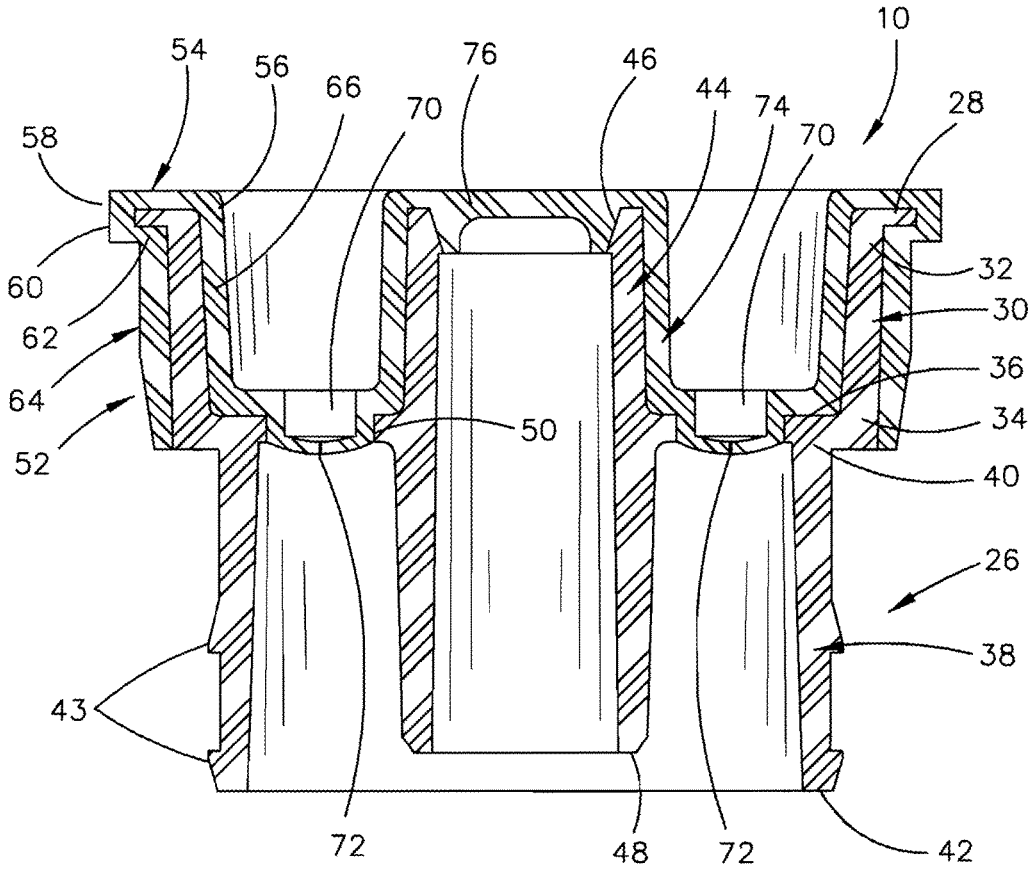
FIG. 3 is a further sectional view of the container insert of this invention.
Figure 4:
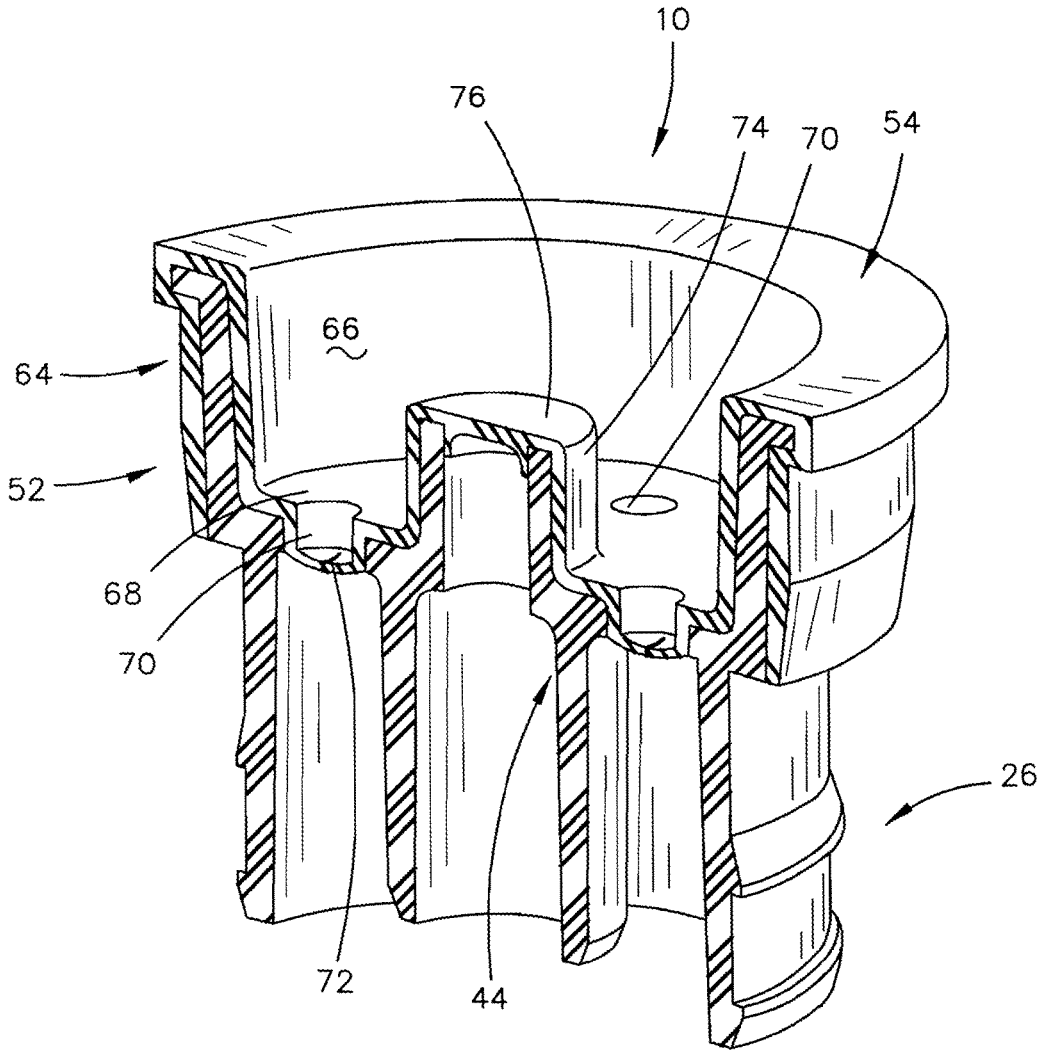
FIG. 4 is a perspective sectional view of a modified form of the container insert of this invention.
Figure 5:
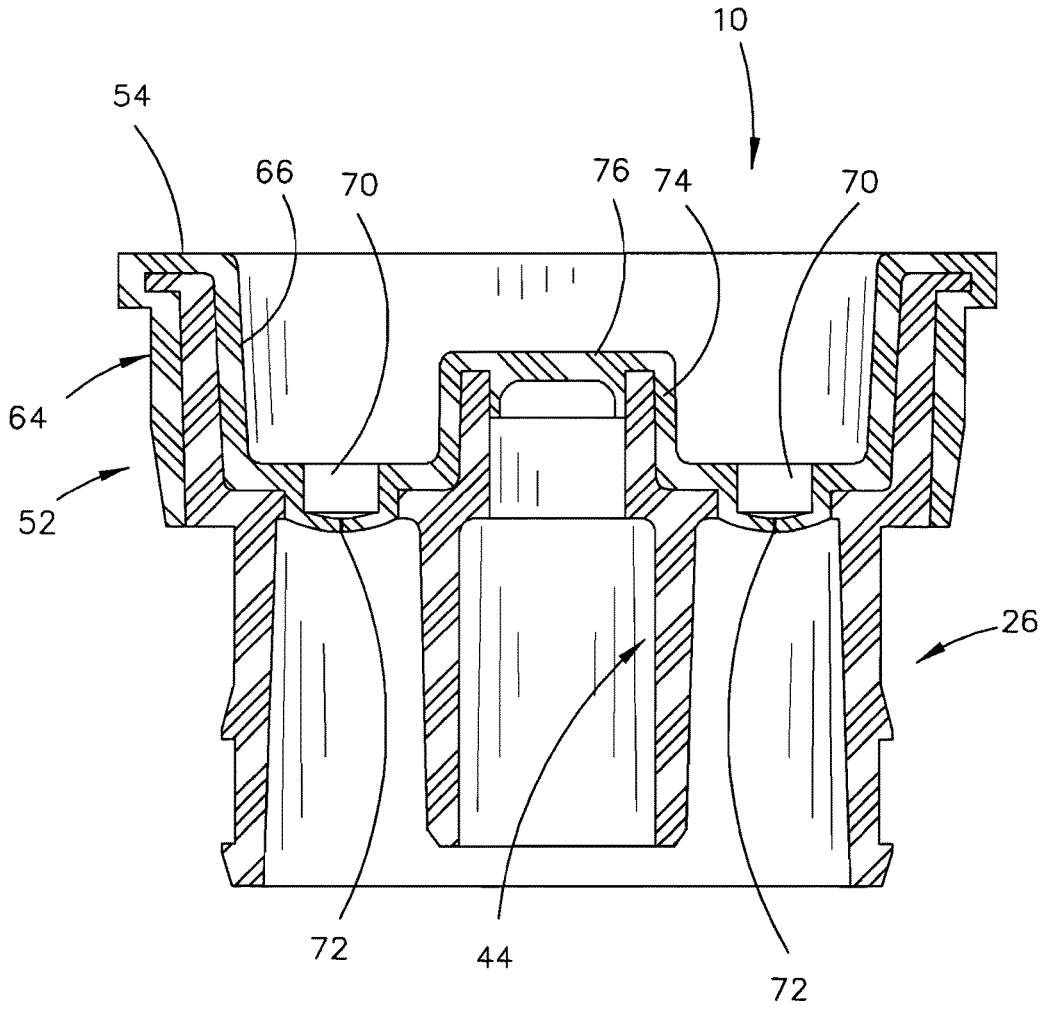
FIG. 5 is a sectional view of the modified container insert of FIG. 4.
Figure 6:
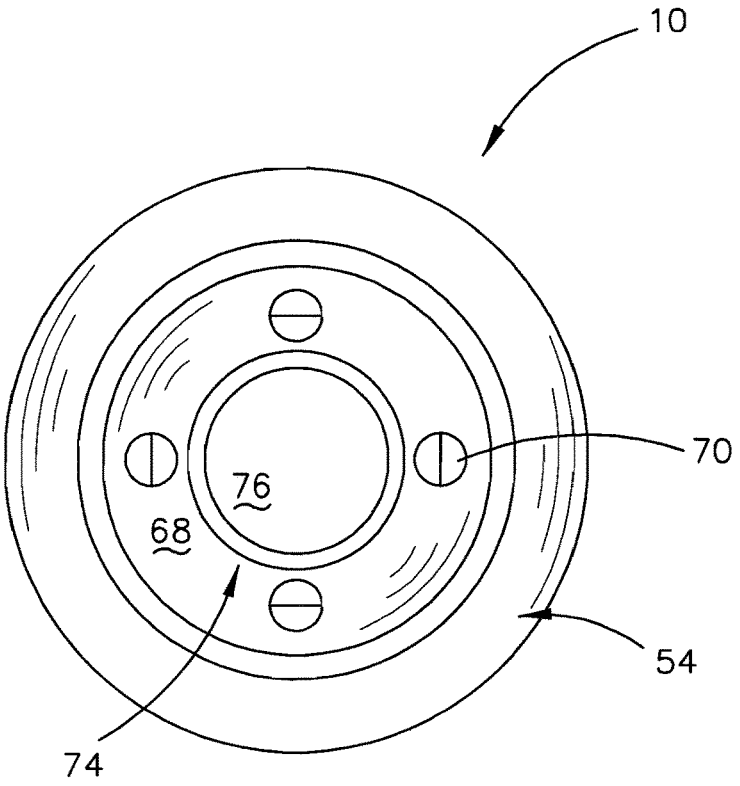
FIG. 6 is a top view of the container insert of this invention.
Figure 7:
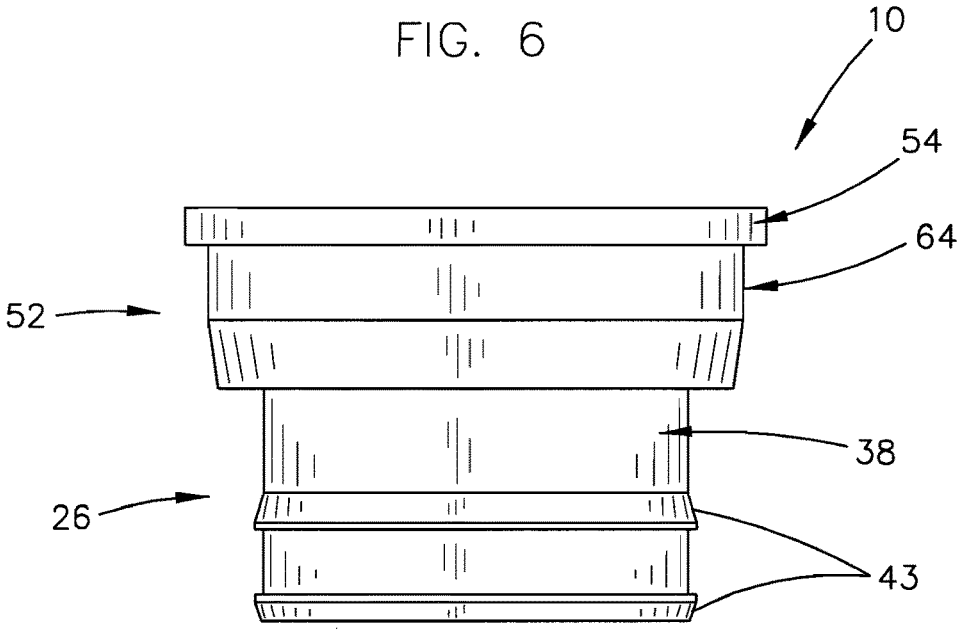
FIG. 7 is a side view of the container insert of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers to the container insert of this invention which is used in a closed loop dispensing system. The closed loop dispensing system includes a container 12 having a throat 14 at its upper end and which has an inner surface 16 (not shown) and an externally threaded outer surface 18. As will be explained hereinafter, insert 10 is selectively removably positioned in the throat 14 of the container 12 as described in my earlier patents. A dip tube 20 is secured to the lower end of insert 10 as will be described hereinafter. Dip tube 20 extends downwardly into container 12 in conventional fashion. As will be described hereinafter, a dispenser cap assembly 22 is selectively threadably secured to the externally threaded outer surface 18 of throat 14. As will be described hereinafter, a dispensing tube 24 extends from extends from dispenser cap assembly 22 to a mixing machine, mixer, dispenser, container, etc. as described in my earlier patents.

Insert 10 includes a substrate portion 26 which is comprised of a suitable plastic material. Substrate portion 26 includes a horizontally disposed and ring-shaped lip 28. A generally cylindrical upper wall member 30 extends downwardly from the inner end of lip 28 and has an upper end 32 and a lower end 34. The numeral 36 refers to a horizontally disposed and disc-shaped wall which extends inwardly from the lower end 34 of upper wall member 30. A generally cylindrical and hollow lower wall member 38 extends downwardly from upper wall member 30 inwardly of the lower end 34 of upper wall member 30. Lower wall member 36 will be described as having an upper end 40 and a lower end 42. The outer side of lower wall member 38 has a plurality of ring-shaped gripping members 43 extending therefrom.

Figure 8:
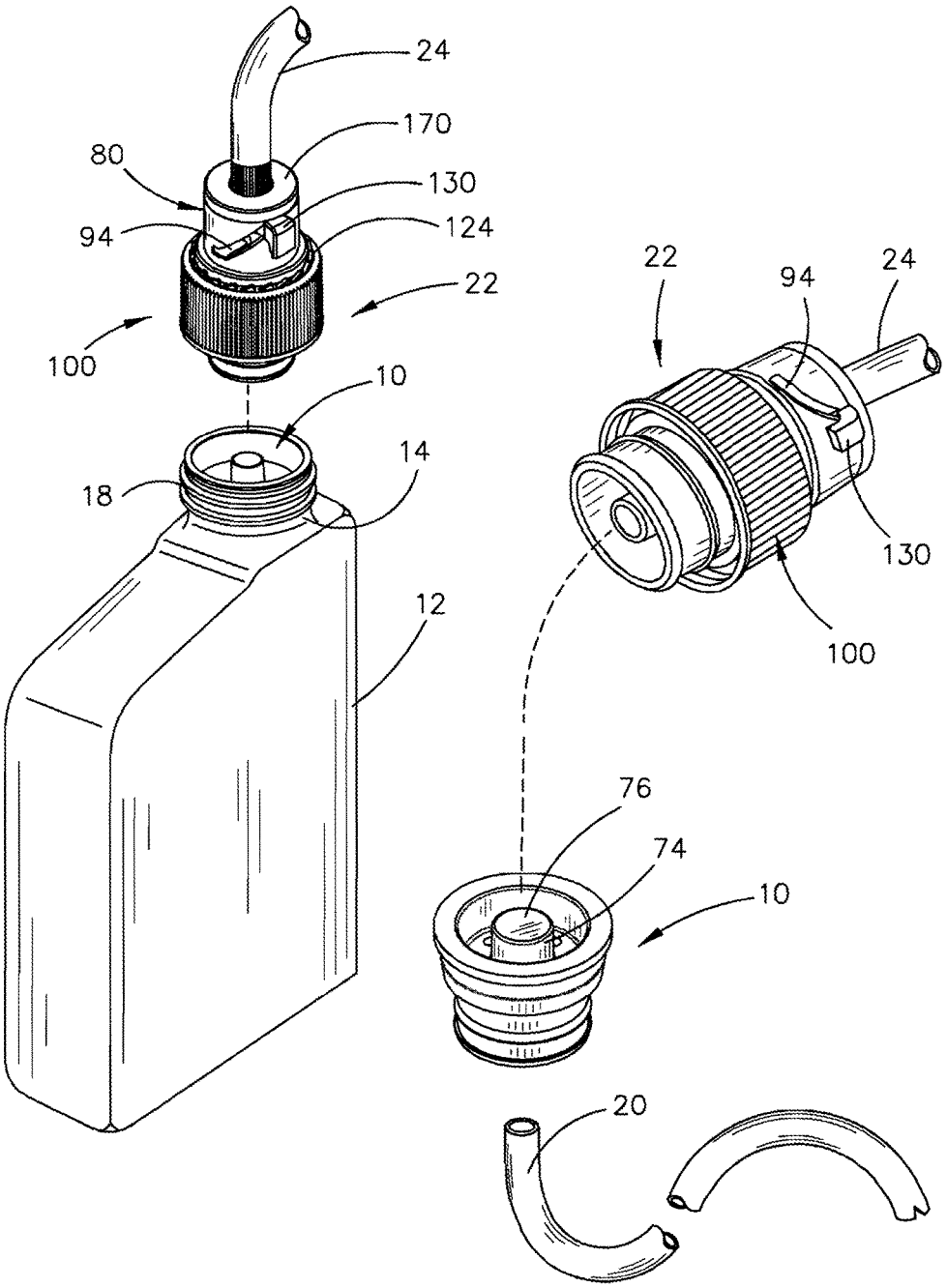
FIG. 8 is an exploded perspective view of the container insert of this invention, a liquid container and a dispenser cap having the container insert of this invention mounted therein.
Figure 9:
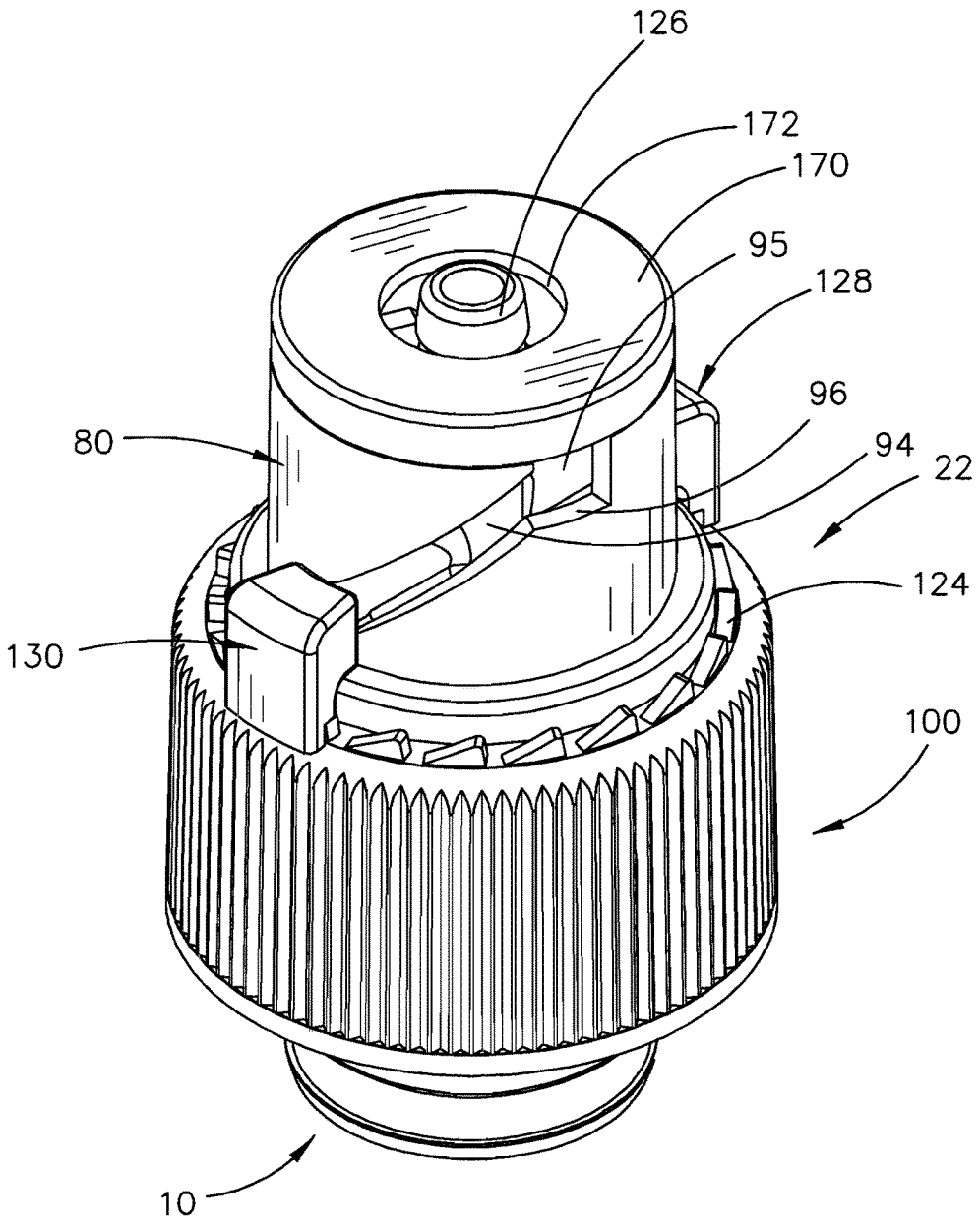
FIG. 9 is a perspective view of the dispensing cap which receives the container insert of this invention.
Figure 10:
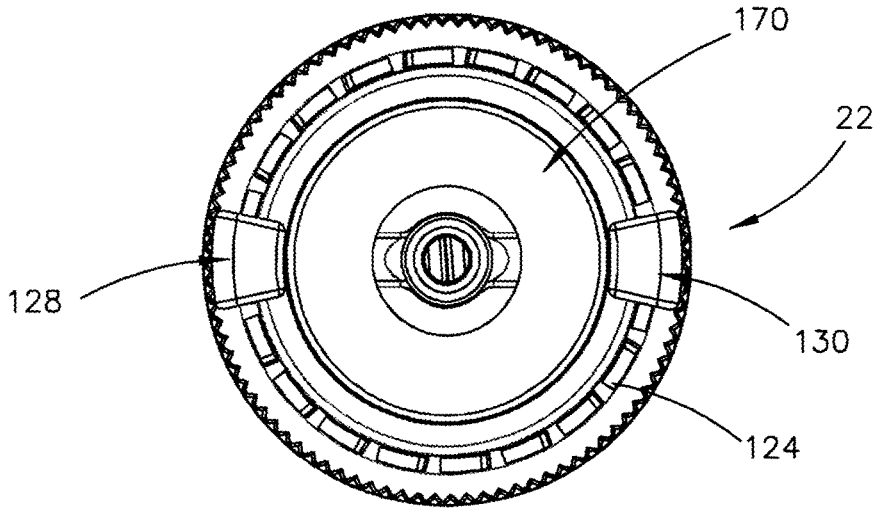
FIG. 10 is a top view of the assembled container insert and dispenser cap of FIG. 9.
Figure 11:
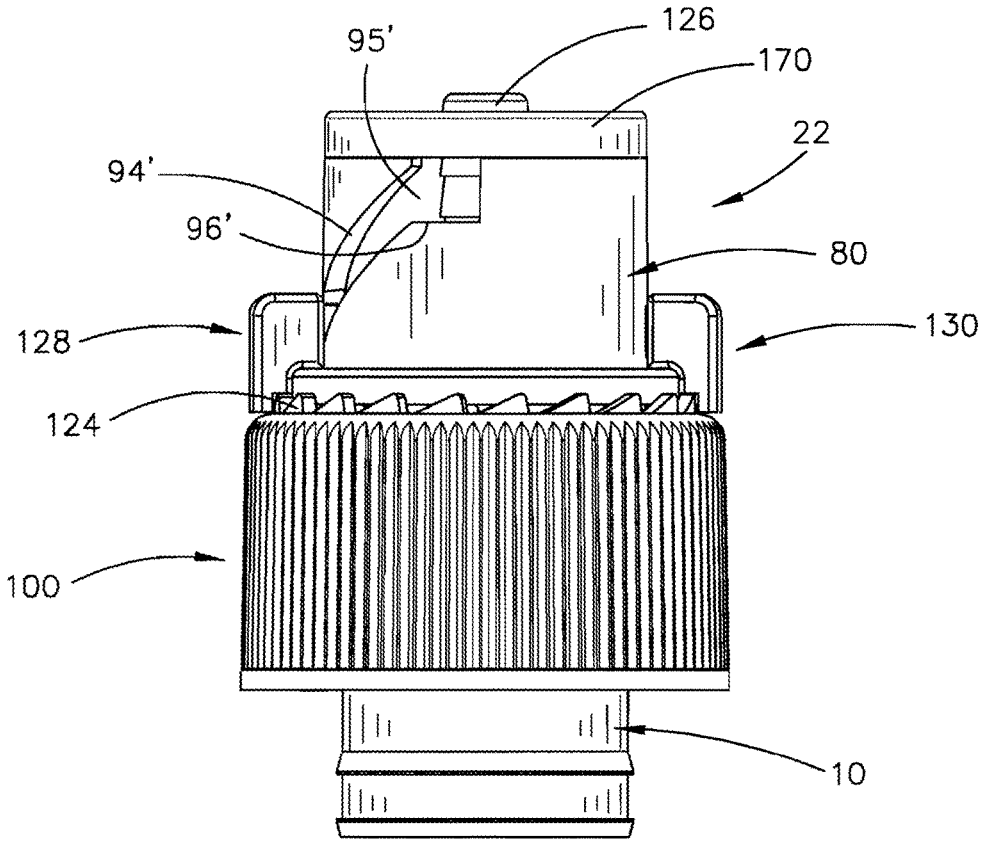
FIG. 11 is a side view of illustrating the container insert of this invention being received in the dispensing cap assembly.
Figure 12:
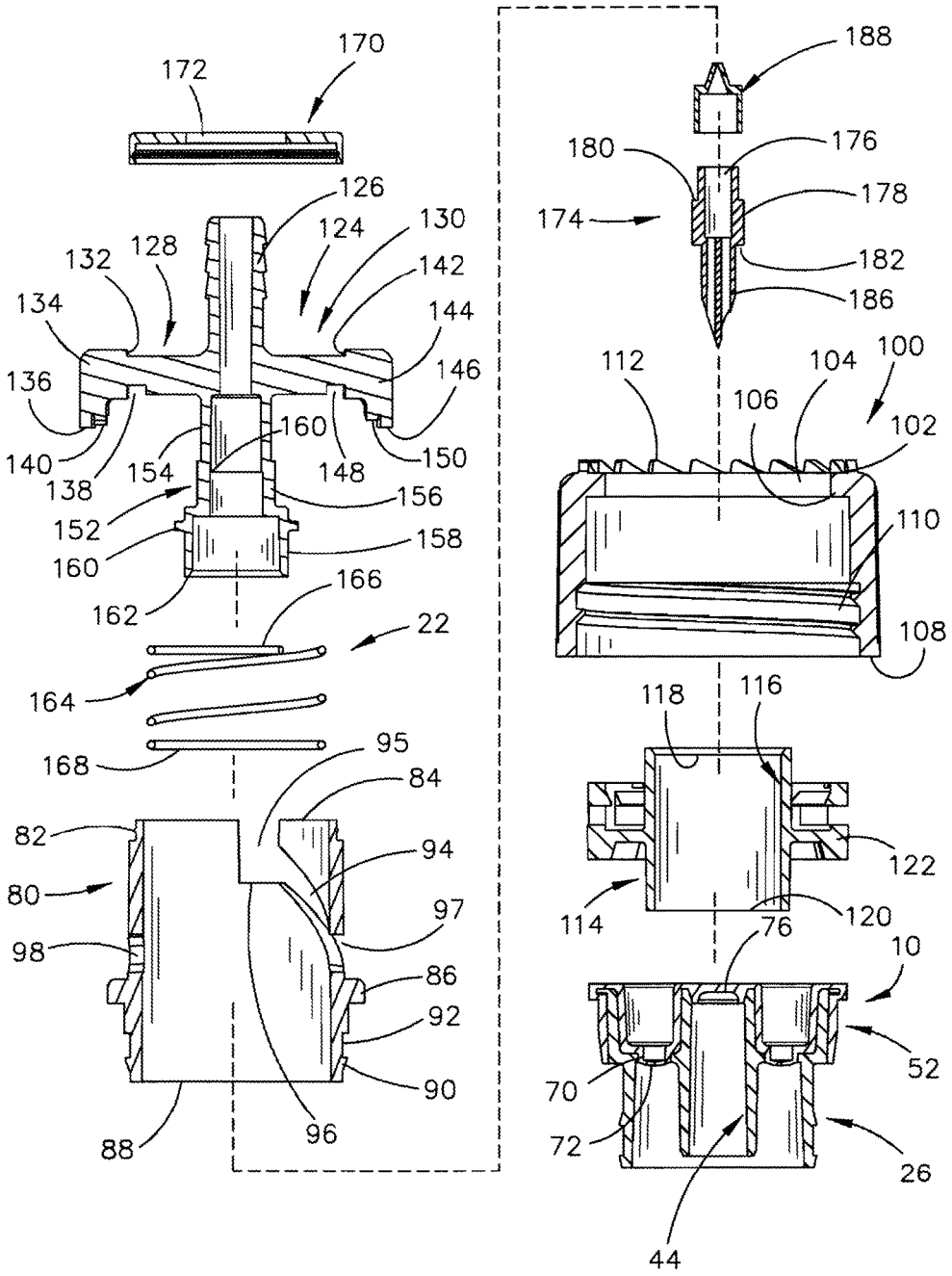
FIG. 12 is an exploded sectional view of the container insert and the associated components.
Figure 13:
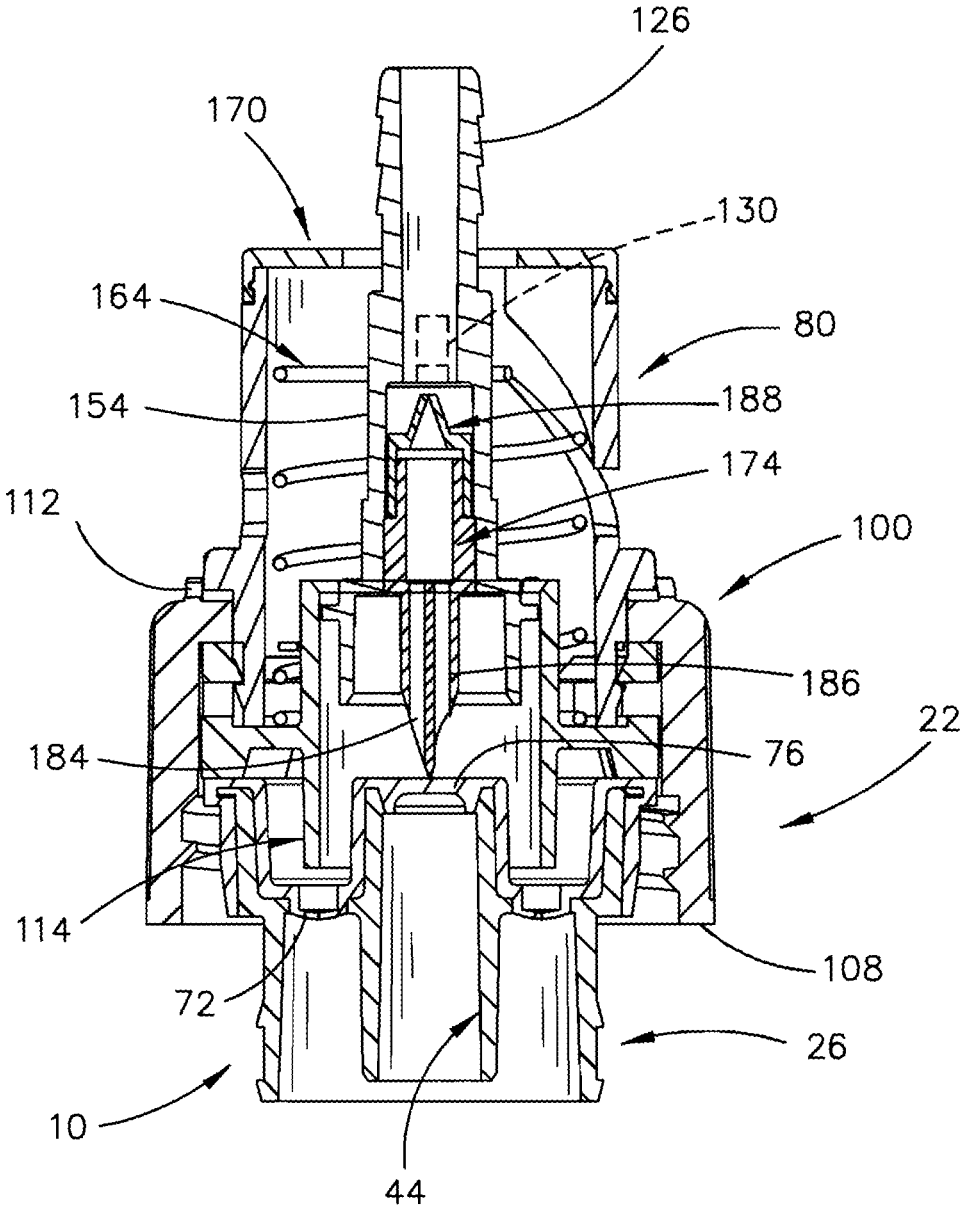
FIG. 13 is a sectional view of the assembled invention with the main chemical flow valve being closed.
Figure 14:
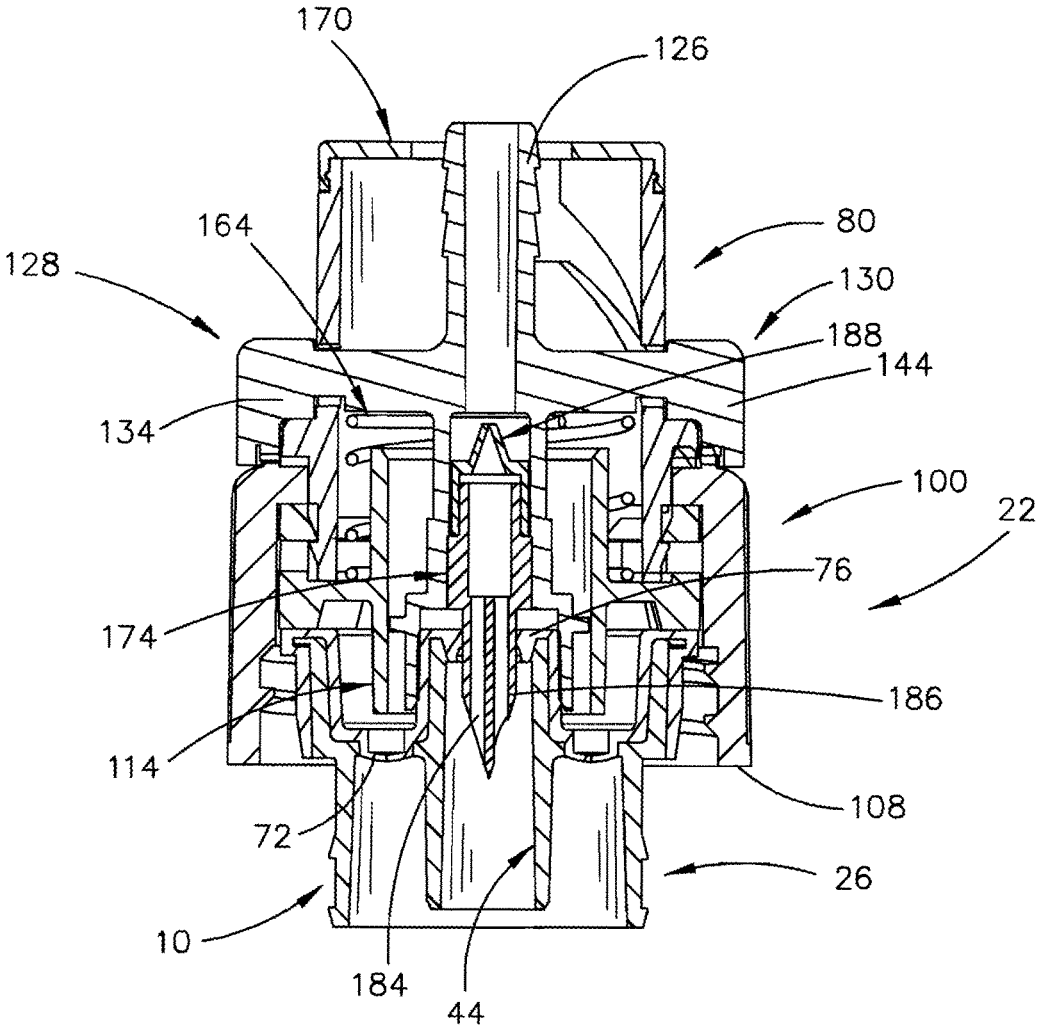
FIG. 14 is a sectional view similar to FIG. 13 except that the main chemical valve has been opened by a lance.

The numeral 44 refers to a vertically disposed tube which is molded with wall 36 at the center thereof with the open upper end 46 of tube 44 being positioned above wall 36 and with the open lower end 48 of tube 44 being positioned below wall 36. Wall 36 is provided with a plurality of radially spaced-apart openings 50 formed therein. Preferably, the upper end 46 of tube 44 is tapered as seen in FIGS. 8 and 9.

The numeral 52 refers to the over-molded portion of the insert 10 which is over-molded onto the substrate portion 26. Over-molded portion 52 includes a horizontally disposed and ring-shaped lip 54 having an inner end 56 and an outer end 58. A vertically disposed and ring-shaped wall 60 extends downwardly from the outer end 58 of lip 54. A short and horizontally disposed wall 62 extends inwardly from the lower end of wall 60. A generally cylindrical and preferably tapered wall 64 extends downwardly from the inner end of wall 62. A generally cylindrical wall 66 extends downwardly from the inner end 56 of lip 54. As seen, lip 28 and wall member 30 of substrate portion 26 are embedded in the over-molded portion 52.

Over-molded portion 52 includes a horizontally disposed and disc-shaped wall 68 which extends inwardly from the lower end of wall 66 and which is positioned on wall 36. Wall 68 has a plurality of radially spaced-apart hollow plastic protrusions 70 formed therewith which extend downwardly from wall 68 into the radially spaced-apart openings 50 formed in wall 36. Protrusions 70 have open upper ends and open lower ends.

A plastic or rubber bi-directional slit-type valve 72 is positioned in each of the lower ends of the protrusions 70. The valves 72 are normally closed but will open downwardly to permit venting air to pass downwardly therethrough to vent the container. The valves 72 will also open upwardly to permit gas in the container to pass upwardly therethrough. Each of the bi-directional valves 72 are designed so that it takes greater cracking pressure to off-gas the chemical in container 12 than the amount of pressure to let venting air into the container.

The over-molded portion 52 of the insert 10 includes an upstanding cylindrical member 74 which extends upwardly from wall 68 so as to embrace the upper portion of tube 44 as seen in the drawings. A flexible rubber valve 76 extends over the upper end of member 74. Valve 76 is of the self-sealing type.

The dispenser cap assembly 22 includes a vertically disposed hollow cylindrical member 80 having external threads 82 at its upper end 84. Member 80 has an annular shoulder 86 extending outwardly therefrom above its lower end 88. An annular shoulder 90 extends outwardly from member 80 at the lower end thereof. An annular recess 92 is formed in member 80 above the lower end thereof. Member 80 also has a curved cam slot 94 formed therein which extends downwardly in an arcuate manner from the upper end of member 80.

Housing 80 has an opening 95 formed therein which extends downwardly from the upper end of housing 80. The lower end of opening 95 defines a shoulder 96. Opening 95 communicates with the upper end of cam slot 94. The lower end of cam slot 94 communicates with opening 97 formed in housing 80. Housing 80 also has a second opening 95', identical to opening 95, which extends downward into the upper end of housing 80, and which is spaced 180 degrees from opening 95. A cam slot 94', identical to cam slot 94, extends downwardly from the opening 95' to opening 98 which is formed in housing 80.

The numeral 100 refers to a cap member having an upper end 102 with an opening 104 formed therein thereby creating a shoulder 106. Cap member 100 includes a lower end 108. Internal threads 110 are formed in cap 100 at the lower end thereof which are adapted to be threadably secured to the threads 18 on container 12. The upper end 102 of cap 100 has a ring of teeth 112 extending upwardly therefrom.

The numeral 114 refers to a valve body having a cylindrical portion 116 with an open upper end 118 and an open lower end 120. Valve body 114 includes an annular shoulder 122 which extends outwardly from cylindrical portion 116. Valve body 114 is snap-fitted into the interior of cap member 100 whereby the annular shoulder 122 engages the lower end 88 of cylindrical member 80 when the cap 22 is assembled and threadably secured to the threads 18 of throat 14 of container 12. When valve body 114 is snap-fitted into cap member 100, the outer end of shoulder 122 frictionally engages the inner surface of cap member 100.

The numeral 124 refers to an actuator having a vertically disposed hollow tube portion 126 at its upper end which is adapted to have the dispensing tube 24 secured thereto. Elongated actuator arms 128 and 130 extend horizontally outwardly from the lower end of tube portion 126. Arm 128 has a shoulder 132 formed therein inwardly of the enlarged head portion 134 which has a lower end 136. A recess 138 extends upwardly into arm 128 inwardly of head portion 134. The lower end of head portion 134 has a recessed portion 140 at the underside thereof.

Arm 130 has a shoulder 142 formed therein inwardly of the enlarged head portion 144 which has a lower end 146. A recess 148 extends upwardly into arm 130 inwardly of head portion 144. The lower end of head portion 144 has a recessed portion 150 at the underside thereof.

Actuator 124 has a hollow lower tube 152 including tube portions 154, 156 and 158. An annular shoulder 160 extends outwardly from the upper end of tube portion 158. A shoulder 160 is formed between tube portions 154 and 156. As seen, tube portion 158 has a much larger diameter than tube portions 154 and 156. Tube portion 158 will be described as having a lower end 162.

The numeral 164 refers to a coil spring having an upper end 166 and a lower end 168. The numeral 170 refers to a cap having an opening 172 formed therein. Cap 170 is designed so as to be screwed onto the threaded portion 82 of cylindrical member 80.

The numeral 174 refers to a metal lance having an open upper end 176, an enlarged portion 178 defining a shoulder 180 at its upper end and a shoulder 182 at its lower end. Lance 174 includes a pointed lower end 184 having radially spaced-apart and longitudinally extending barbs 186 extending outwardly therefrom.

The numeral 188 refers to a normally closed one-way valve which is mounted on the upper end of lance 174 for movement therewith. Valve 188 prevents the flow of liquid downwardly therethrough. Valve 188 will open to permit the flow of liquid upwardly therethrough.

In use, prior to complete assembly, the insert 10 will be inserted into the throat 14 of container 12. A shipping cap, such as shown in my earlier patents, will be secured to the threads 18 of the throat 14 of the container 12 when the invention is going to be shipped. At that time, the dip tube 20 will be positioned in the container 12.

When it is desired to place the container 12 and the insert 10 into use, the shipping cap will be removed from the container 12. The valve body 114 is press-fitted into cap 100. If not done so before, the lance 174, with the valve 188 attached, will be inserted into the lower end of actuator 124. The lower end of housing 80 will then be inserted downwardly into cap 100. The spring 164 will have been previously inserted. The actuator will then be mounted on the housing 80 by inserting arms 128 and 130 downwardly into the open upper ends of openings 95 and 95' until the arms 128 and 130 rest on shoulders 96 and 96'. The cap 170 will then be screwed onto the threads 82 of housing. The tube 126 will then be connected to the dispensing tube 24 which will be extended to a mixer, etc.

When it is desired to deliver liquid from the container 12, the actuator 124 is rotated with respect to housing 80 so that the arms 128 and 130 move downwardly in the curved cam slots 94 and 94'. The downwardly movement of the actuator 124 causes the lance 174 to move downwardly with respect to the insert 10. The downward movement of lance 174 causes the pointed lance to pierce the valve 76 of insert 10 to open the valve 76. Liquid is then sucked upwardly through the lance 174, through the one-way valve 188, upwardly through actuator 124 and outwardly into the dispenser tube 24. When the arms 128 and 130 are in the lower position, they are received in the openings 98 and 97 which yieldably maintain the actuator 124 in its lower piercing position to maintain the valve 76 in its open position to permit liquid from the container 12 to pass therethrough, through the one-way valve 188 and outwardly through tube 126 into the tube 24.

When it is desired to discontinue the flow of liquid from the container 12, the actuator 124 is rotated so that the arms 128 and 130 move upwardly in the curved cam slots 94 and 94' until the arms 128 and 130 are positioned in openings 95 and 95' and are resting on the shoulders 96 and 96' which maintain the arms 128 and 130 in their upper position. The coil spring 164 urges the actuator 124 upwardly. The upward movement of arms 128 and 130 causes lance 174 to be withdrawn from valve 76. The valve 76 is comprised of a self-sealing material so that the opening in valve 76 caused by the lance 174 will be sealed.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A closed loop dispensing system including a liquid container having a throat with an inside surface and an externally threaded portion, comprising:

a container insert for positioning in said throat;

said container insert including:

(a) a horizontally disposed ring-shaped lip having an upper side, a lower side, an outer end and an inner end;

(b) a generally cylindrical upper wall member having an open upper end, an open lower end, an inner side and an outer side;

(c) said upper wall member extending downwardly from said inner end of said lip whereby said lip protrudes outwardly from said upper end of said upper wall member;

(d) a generally cylindrical lower wall member having an open upper end, an open lower end, an inner side and an outer side;

(e) said lower wall member extending downwardly from said lower end of said upper wall member whereby said lower end of upper wall member is positioned outwardly of said upper end of said lower wall member thereby creating an annular-shaped shoulder therebetween which has an upper and a lower end;

(f) a horizontally disposed and generally disc-shaped wall at said lower end of said upper wall member having an upper side and a lower side;

(g) a vertically disposed and cylindrical hollow tube, having an open upper end and an open lower end, centrally positioned in said disc-shaped wall;

(h) said open upper end of said hollow tube being positioned above said disc-shaped wall;

(i) said open lower end of said hollow tube being positioned below said disc-shaped wall;

(j) a flexible valve, having an upper side and a lower side, positioned in said open upper end of said hollow tube to normally close said open upper end of said hollow tube;

(k) said disc-shaped wall having a plurality of radially spaced-apart and downwardly extending hollow protrusions formed therein with each of said protrusions having an open upper end and an open lower end;

(l) each of said protrusions having a bi-directional valve at said lower end thereof;

(m) each of said bi-directional valves being normally closed to prevent liquid from passing upwardly therethrough;

(n) each of said bi-directional valves being movable downwardly to an open position to permit air to pass downwardly therethrough to vent the container;

(o) each of said bi-directional valves being movable upwardly to an open position to permit gas in the container to pass upwardly therethrough;

a dispensing cap assembly having upper and lower ends;

said lower end of said dispensing cap assembly being threadably secured to the externally threaded portion of said throat of said liquid container so as to extend upwardly therefrom;

said dispensing cap assembly having a selectively vertically movable hollow lance mounted therein which is movable between an upper position and a lower position with respect to said valve of said container insert;

said hollow lance having an open upper end and a pointed open lower end;

said lance being configured to permit liquid to flow upwardly therethrough;

said pointed lower end of said hollow lance being positioned above said flexible valve when said lance is in said upper position;

said pointed lower end of said hollow lance extending downwardly through said flexible valve, to pierce and open said flexible valve, when said lance is moved downwardly from said upper position to said lower position;

said dispensing cap including structure to selectively cause the movement of said hollow lance from said upper position to said lower position and to cause said hollow lance to move from said lower position to said upper position;

a normally closed one-way valve mounted on said upper end of said lance and which has a liquid intake side and a liquid discharge side;

said normally closed one-way valve preventing the downward flow of liquid therethrough when said lance is in said upper position;

said normally closed one-way valve being movable to an open position to permit the flow of liquid upwardly therethrough from said container insert and said liquid container when said lance is in said lower position; and said dispensing cap assembly includes a dispenser tube extending therefrom which is in liquid communication with said liquid discharge side of said normally closed one-way valve.

2. The closed loop dispensing system of claim 1 wherein said dispensing cap assembly includes structure for moving said lance and said one-way valve between said upper and lower positions.

3. The closed loop dispensing system of claim 2 wherein said structure for moving said lance and said one-way valve between said upper and lower positions comprises a cam follower mechanism.

4. The closed loop dispensing system of claim 1 further including structure for selectively maintaining said lance in said upper position.

5. The closed loop dispensing system of claim 1 further including structure for selectively maintaining said lance in said lower position.

6. The closed loop dispensing system of claim 4 wherein said structure for selectively maintaining said lance in said upper position comprises a coil spring.

7. A closed loop dispensing system including a liquid container having a threaded throat with an inside surface, comprising:

a container insert, having upper and lower ends, positioned in said throat;

said container insert having a liquid flow channel, with upper and lower ends, extending upwardly therethrough;

said lower end of said liquid flow channel being in communication with the liquid in the liquid container;

a resealable valve member normally closing upper end of said liquid flow channel;

a dispensing cap assembly having a liquid flow channel, having upper and lower ends, secured to throat of said liquid container;

said lower end of said liquid flow channel of said dispensing cap assembly being in communication with said resealable valve member;

said upper end of said liquid flow channel of said dispensing cap assembly being configured to be secured to a dispensing tube;

a selectively vertically movable hollow lance positioned in said liquid flow channel of said dispensing cap assembly;

said hollow lance being selectively movable between an upper position and a lower position;

said hollow lance, when in said upper position, being spaced from said resealable valve member; and said hollow lance, when in said lower position, piercing said resealable valve member to permit liquid from the liquid container to flow upwardly therethrough to the dispensing tube.

8. The closed loop dispensing system of claim 7 further including a one-way valve associated with said hollow lance to prevent liquid flow downwardly through said hollow lance while permitting liquid flow upwardly through said hollow lance.

9. The closed loop dispensing system of claim 7 further including structure for selectively maintaining said hollow lance in said upper position.

10. The closed loop dispensing system of claim 7 further including structure for selectively maintaining said hollow lance in said lower position.

11. A container insert for insertion into the throat of a liquid container of a closed loop dispensing system, comprising:

a plastic substrate portion including:

(a) a horizontally disposed ring-shaped lip having an upper side, a lower side, an outer end and an inner end;

(b) a generally cylindrical upper wall member having an open upper end, an open lower end, an inner side and an outer side;

(c) said upper wall member extending downwardly from said inner end of said lip whereby said lip protrudes outwardly from said upper end of said upper wall member;

(d) a horizontally disposed and generally disc-shaped wall at said lower end of said upper wall member having an upper side and a lower side;

(e) a generally cylindrical lower wall member having an open upper end, an open lower end, an inner side and an outer side;

(f) said lower wall member extending downwardly from said disc-shaped wall inwardly of said lower end of said upper wall member;

(g) a vertically disposed and cylindrical hollow tube, having an open upper end and an open lower end, molded with said disc-shaped wall at the center of said disc-shaped wall;

(h) said open upper end of said hollow tube being positioned above said disc-shaped wall;

(i) said open lower end of said hollow tube being positioned below said disc-shaped wall;

(j) said open lower end of said hollow tube being configured to have a dip tube secured thereto with the dip tube being in liquid communication with the container;

(k) said disc-shaped wall having a plurality of radially spaced-apart openings formed therein outwardly of said hollow tube;

an over-molded portion including:

(a) a horizontally disposed and ring-shaped lip positioned on said upper side of said lip of said substrate portion with said lip having an inner end and an outer end;

(b) a vertically disposed first wall section, having upper and lower ends, extending downwardly from said outer end of said lip of said over-molded portion outwardly of said lip of said substrate portion;

(c) a horizontally disposed second wall section, having inner and outer ends, extending inwardly from said lower end of said first wall section below said lip of said substrate section;

(d) a vertically disposed and generally cylindrical third wall section, having upper and lower ends, extending downwardly from said inner end of said second wall section at said outer side of said upper wall member of said substrate portion;

(e) a vertically disposed and generally cylindrical inner wall section, having upper and lower ends, extending downwardly from said inner end of said lip of said over-molded portion at said inner side of said upper wall member of said substrate portion;

(f) a horizontally disposed and generally disc-shaped wall at said lower end of said inner wall section of said over-molded portion;

(g) a vertically disposed and hollow cylindrical tube, having an open upper end, extending upwardly from said disc-shaped wall of said over-molded portion which embraces said hollow tube of said substrate portion;

(h) a flexible valve, having an upper side and a lower side positioned in said open upper end of hollow cylindrical tube of said over-molded portion to normally close said open upper end of said hollow tube of said substrate portion and said hollow cylindrical tube of said over-molded portion;

(i) said flexible valve being opened upon said flexible valve being pierced thereby permitting liquid from said container to be passed upwardly therethrough;

(j) structure for piercing said flexible valve;

(k) said disc-shaped wall of said over-molded portion having a plurality of radially spaced-apart openings formed therein which register with said radially spaced-apart openings formed in said disc-shaped wall of said substrate;

(l) a hollow plastic protrusion, having upper and lower ends, extending downwardly from each of said plurality of spaced-apart openings in said disc-shaped wall of said over-molded portion through a registering opening of the said plurality of radially spaced-apart openings in said disc-shaped wall of said substrate;

each of said protrusions having a bi-directional valve at said lower end thereof;

each of said bi-directional valves being normally closed to prevent liquid from passing upwardly therethrough; and each of said bi-directional valves being movable to an open position to permit air to pass downwardly therethrough to vent the container.

12. The container insert of claim 11 wherein said container insert is entirely comprised of a plastic material.

13. The container insert of claim 11 wherein each of said bi-directional valves have a single slit formed therein.

14. The container insert of claim 11 wherein said structure for piercing said flexible valve comprises a vertically movable lance.

15. The container insert of claim 14 further including a can follower mechanism for moving said lance.

* * * * *